United States Patent [19]

Schoofs

[11] Patent Number: 4,674,243

[45] **Date of Patent: * Jun. 23, 1987**

[54] INSULATING GLASS UNIT AND SPACER BAR THEREFOR

[75] Inventor: Richard J. Schoofs, Moraga, Calif.

[73] Assignee: Schoofs Incorporated, Moraga, Calif.

[ * ] Notice: The portion of the term of this patent subsequent to Jun. 26, 2001 has been disclaimed.

[21] Appl. No.: 648,578

[22] Filed: Sep. 10, 1984

[51] Int. Cl.[4] ..... E04C 1/42; E04C 2/54; E06B 7/12

[52] U.S. Cl. ..... 52/172; 52/304; 52/790

[58] Field of Search ..... 52/171, 172, 788, 790, 52/304

[56] References Cited

U.S. PATENT DOCUMENTS

| | | | |
|---|---|---|---|
| 3,570,201 | 6/1969 | Barroero | 52/172 |
| 3,771,276 | 11/1973 | Stewart et al. | 52/172 |
| 4,144,196 | 3/1979 | Schoofs | 52/788 X |
| 4,232,492 | 11/1980 | Remick et al. | 52/172 |
| 4,455,796 | 6/1984 | Schoofs | 52/790 X |

*Primary Examiner*—Stuart S. Levy
*Assistant Examiner*—Lynn M. Sohacki
*Attorney, Agent, or Firm*—Limbach, Limbach & Sutton

[57] ABSTRACT

A spacer bar for use in double glazed windows is disclosed. The spacer bar is an elongated tube or conduit having a generally rectangular cross section. The spacer bar has two pairs of opposing planar faces. Each planar surface of one pair lies against the interior surface of one of the glass panes of the double glazed window and one planar surface of the other pair faces the space between the panes and the other planar surface of said other pair faces the atmosphere. A small diameter tube passes through the surface facing the atmosphere. The portions of the small diameter tube lying on either side of the conduit surface are bent downwardly. The portion of the small diameter tube which lies inside the conduit is bent downwardly and extends to a point at least 5 inches below its entry point and the other portion of the small diameter tube which lies outside the conduit is also bent downwardly so that it lies adjacent to and generally parallel to the outer face of the conduit. The planar surface of the spacer bar which faces the space between the panes has a small opening in it which lies at least about 5 inches from the interior end of the small diameter tube. A double glazed window as fitted with the spacer bar as above described is also disclosed.

7 Claims, 2 Drawing Figures

INSULATING GLASS UNIT AND SPACER BAR THEREFOR

DESCRIPTION

1. Technical Field

This invention relates to insulating glass units which are essentially free of glass deflection, and to spacer bars for use in such insulating glass units.

2. Background of the Invention

Insulating glass units generally consist of two or more parallel panes of glass which are spaced apart from each other and which have the space between the panes sealed along the peripheries of the panes to enclose an air space between them. The most commonly used insulating glass units are double glazed windows. A double glazed window consists of two usually rectangular panes of glass which are placed in congruent relationship. Spacer bars are placed along the periphery of the space between the two panes. The spacer bars are long, hollow prisms having cross sections which are generally rectangular. The peripheries of the two panes and the spacer bars lying between them are sealed with a sealing composition so that the air space enclosed between the panes is sealed from contact with the outside atmosphere. The surfaces of the spacer bars facing the interior of the enclosed air space are perforated or slotted and the spacer bars themselves are filled with a solid adsorbent capable of taking up water vapor and organic materials which may be present in the enclosed air space when the unit is sealed with an organic sealant or which may enter the enclosed air space by diffusion from the sealant after sealing. Air enclosed in the space between the panes diffuses through the slots or perforations in the spacer bars and contacts the adsorbent in the interior of the spacer bars with the result that water vapor and any solvent or organic material getting into the enclosed air space from the sealing compound are adsorbed on the adsorbent employed. The result is that cooling of the interior air does not cause deposition of water vapor or organic material on the interior surfaces of the panes.

Insulating glass units of this design are frequently subjected to deflection of the glass panes due to pressure changes when the temperature of outside air changes, adsorption or desorption of nitrogen or other gases on or from the adsorbent, and changes in atmospheric pressure. When the pressure of the air in the space enclosed between the panes becomes less than the exterior pressure, the panes are forced closer together. When the pressure in the space between the panes is greater than the exterior pressure the panes are forced apart. Since the peripheries of the panes are held in pretty much fixed position by the sealant, deflection is observed to occur in the area of the glass lying inside the peripheries of the panes.

Deflection gives rise to several problems which must be faced by the manufacturer and/or the user of the insulated glass units. When appreciable deflection occurs the reflected images from the windows are distorted and present an undesirable cosmetic effect. This effect may not be functionally serious but users of the insulating glass units object to the distorted reflections. Deflection which results in the movement of the two panes of glass closer together or farther apart when the exterior pressure is greater or less than the pressure of the enclosed air space between the panes also places stress on the sealing compounds which lie along the periphery of the insulating glass unit and gradually weaken the seals so that leakage of the relatively moist exterior air into the enclosed space occurs with the result that the capacity of the adsorbent in the spacer bars is exhausted and condensation of moisture at low temperature begins to appear in the windows. Deflection which results when the panes are forced closer together decreases the insulating properties of the unit since these properties are a function of the width of the air space between the panes. If the panes are forced into contact with each other insulating properties are lost. Serious deflection can also cause cracking and even breakage of the windows particularly along the peripheries of the panes.

The deflection problem has been recognized and steps have been taken to reduce the amount of deflection experienced during transportation or use of the insulating glass units.

For example, it has been recognized that pressure problems arise when insulating glass units are shipped from a point of manufacture to a point of use and the altitudes between the two points are substantially different. In these situations a small open tube, commonly known as a "breather tube", is sometimes inserted into the side of the spacer bar facing the exterior of the insulating glass unit. The breather tube permits flow of air between the interior of the insulating glass unit and the ambient atmosphere and thereby equilibrates the pressure. Typically, the breather tube is sealed immediately after the unit is transported to the altitude at which it is to be installed.

More recently it has been found that if the diameter of the breather tube is sufficiently small (of the order of 0.01 to 0.05 inch) and sufficiently long (generally of the order of at least one foot or more) that entry of outside air into the insulating glass unit by simple diffusion is minimized and the insulating glass unit will exhibit sufficiently long life even if a breather tube of these dimensions is not sealed. It should be noted that breather tubes of this kind generally enter the side of the spacer bar facing the exterior of the insulating glass unit, and when the pressure in the space between the panes is less than the exterior pressure air is "inhaled" into the space enclosed between the panes of the unit. The air flows through the breather tube, through a small segment of the spacer bar and then through the slots or perforations in the spacer bar into the air space enclosed between the panes of the unit. When the pressure in the space between the panes exceeds the exterior pressure, air is "exhaled" from the space between the panes and the air flow is in the reverse direction.

Only recently it has been recognized that a serious cause of deflection in insulating glass units is the fact that the adsorbents with which the spacer bars have been filled adsorb nitrogen when the temperature in the interior of the space between the panes is low and desorb nitrogen when the temperature of the space between the panes is high. Deflection caused by nitrogen adsorption and desorption as temperature changes has been substantially eliminated by using adsorbents to fill the spacer bars which are incapable of adsorbing nitrogen but which do adsorb water vapor. This reduction of the nitrogen adsorption problem as relating to deflection is described in U.S. Pat. No. 4,144,196.

BRIEF DESCRIPTION OF THE INVENTION

It has now been found that deflection of the panes of insulating glass units, however caused, may be substantially eliminated by employing a spacer bar of the following construction. The spacer bar is an elongated tube or conduit having a generally rectangular cross section. The bar has two pairs of opposing planar surfaces. Each planar surface of one pair lies against the interior surface of one of the glass panes. One planar surface of the other pair faces the space between the panes and the other planar surface of the pair faces the atmosphere. A small diameter tube passes thru the surface facing the atmosphere. The portions of the small diameter tube lying on either side of the conduit surface are bent downwardly. The portion of the small diameter tube which lies inside the conduit is bent downwardly and extends downwardly to a point at least 5 inches below the small opening in the other face of the conduit. The portion of the small diameter tube which lies outside the conduit is also bent downwardly so that it lies adjacent to and generally parallel to the outer face of the conduit. When the spacer bar is in use a segment of the bar extending from the small opening in the interior face to a point at least 5 inches below that opening is filled with a solid adsorbent. The entire length of the bar may, if desired, be filled with this adsorbent. When the window in which the spacer bar is placed is cooled, the pressure in the space between the panes of the window is reduced and air flows from the atmosphere through the small diameter tube and then through the solid adsorbent with which the tube or segment of the tube is filled and then outward into the space between the panes through the small opening in the interior face of the conduit. When the window is heated the pressure of the air in the space between the panes is increased, air flows from the space between the panes through the small opening in the interior face of the conduit then downwardly through the adsorbent and enters the opening at the end of the small diameter tube and flows through the small diameter tube outward to the atmosphere. The result is that the space between the panes remains at essentially constant pressure and therefore no deflection either inwardly or outwardly occurs when the temperature of the windows changes.

Additionally, when the temperature is low the air which passes into the space between the panes through the small diameter tube, passes through the mass of solid adsorbent lying between the interior opening of that tube and the small opening in the other of the two parallel faces of the conduit and then thru the small opening into the space between the panes. During this passage moisture is adsorbed by the adsorbent. On the other hand, when the temperature of the window is raised the air in the space between the panes becomes heated and the hot air flows through the small opening in the interior face of the conduit through the adsorbent and then through the small diameter tube to the atmosphere. The passage of the hot gas through the mass of adsorbent causes desorption of water and reactivation of the portion of the adsorbent through which it passes.

In another embodiment of the spacer bar of the invention the surface of the conduit facing the space between the panes has a number of small openings in its surface. These openings are spaced at least 10 inches apart and at least a portion of the conduit opposite these openings is filled with particulate solid adsorbent. A small diameter tube passes through the exterior face of the conduit as above described and the portion of the small diameter tube which lies inside the conduit extends downwardly and terminates at a point between two of the openings in the interior face of the conduit not less than about 5 inches from the opening in the interior face of the conduit which is nearest the end of the small diameter tube. Substantially constant pressure in the space between the panes is obtained by this arrangement and also the alternate adsorption-desorption of water vapor as air flows inward through the small diameter tube, a segment of adsorbent filled conduit and the opening(s) in the interior face of the conduit into the space between the panes when the window is cooled and outward from the space between the panes through the small opening in the interior face of the conduit, through the adsorbent filled segment of the conduit and then out to the atmosphere through the small diameter tube when the window is warmed.

BEST MODE FOR CARRYING OUT THE INVENTION

Figure 1:
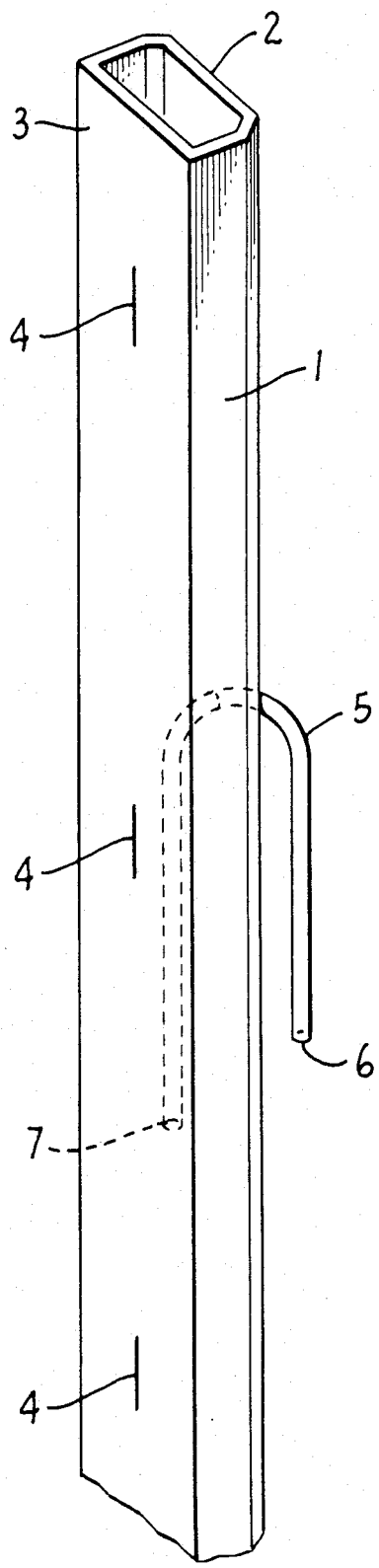
FIG. 1 of the appended drawings is a perspective side view of one embodiment of the spacer tube of the invention.

Referring now to FIG. 1, the spacer bar 1 has a generally rectangular cross section. The bar has opposing planar faces 2 and 3. Planar face 3 faces the interior of the space between the panes when the spacer bar is in place, while planar surface 2 faces the atmosphere. The width of planar face 2 is slighltly less than that of planar face 3 because the corners of the bar are beveled at face 2 to provide easier access of the sealant around the periphery of the window and adjacent to the spacer bar.

Planar surface 3 of the spacer bar has several openings 4 in its surface. These openings may be either circular holes of small diameter or short, narrow slits. These openings are spaced at least 10 inches apart.

In the embodiment of the invention shown in FIG. 1, breather tube 5 passes through planar surface 2 so that part of it lies inside the spacer bar and the other part lies outside the spacer bar. Both of these parts are bent downwardly so that the interior portion of the small tube extends downwardly from the point at which the small tube penetrates face 2 a distance of at least 5 inches, and a distance such that the end 7 of the small tube lying inside the spacer bar will lie approximately midway between two adjacent openings in face 3 of the bar or not less than about 5 inches from the opening in face 3 which is nearest end 7 of tube 5. The exterior portion of the small tube is simply bent downward so that it lies close to face 2 of the spacer bar and runs generally parallel to it. End 6 is open to the atmosphere.

The spacer bar or at least a segment of the bar is filled with a particulate solid absorbent. In the event that only a segment of the bar is filled with the absorbent, the segment of adsorbent-filled spacer bar will be such that at least 5 inches of adsorbent lie between end 7 of tube 5 and the adjacent openings 4 of the spacer bar. Where only a segment of the spacer bar is filled with solid absorbent, a support barrier may be inserted in the spacer bar an appropriate distance below the point at which the small tube penetrates the spacer bar. Where only a segment of the spacer bar is filled with solid absorbent, only one small opening in face 3 of the spacer bar is necessary.

Figure 2:
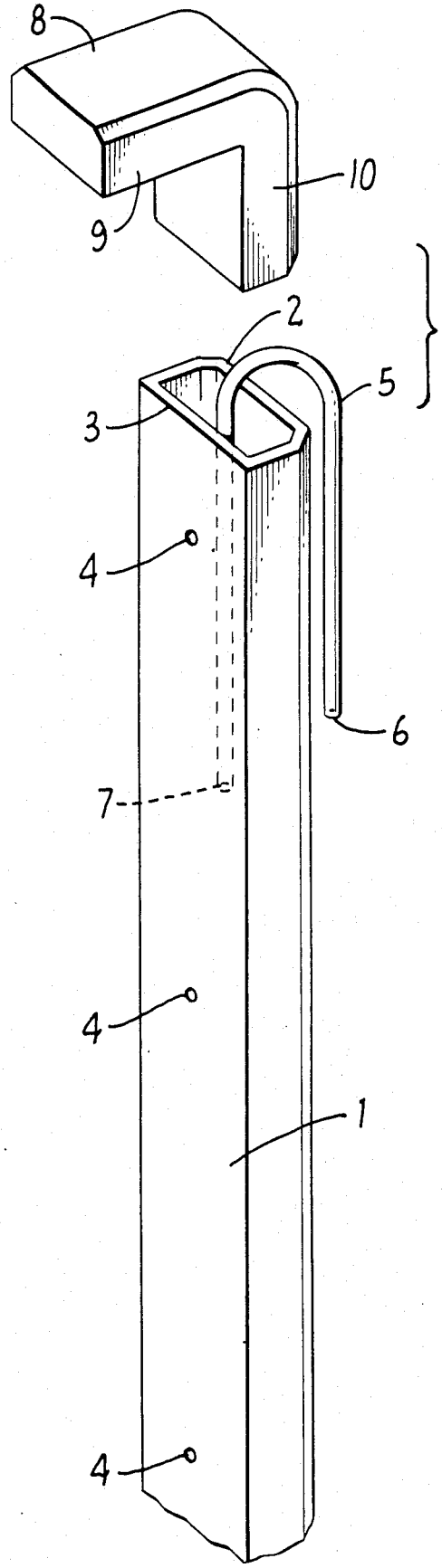
FIG. 2 of the appended drawings is a perspective side view of the spacer bar of the invention and includes the corner key employed for connecting one spacer bar to another.

FIG. 2 discloses another embodiment of the invention. The parts of the apparatus are represented by the same numbers used for corresponding parts of it in FIG. 1.

In this embodiment of the invention the small diameter tube 5 does not pass through surface 2, rather it passes over the top extremity of surface 2. Corner key 8 is shown above the spacer bar and its legs have the same general cross-sectional shape as the spacer bar. Corner keys are commonly made of a plastic material, such as nylon, dacron, and the like, and are so sized that the vertical leg 10 of the key and horizontal leg 9 of the key each have slightly smaller dimensions than the dimensions of the spacer bar itself so that when vertical leg 10 is passed downwardly into spacer bar 1 and small diameter tube is set to lie snugly against face 2 of the spacer bar. The plastic material of which the corner key is composed is reasonably flexible so that when the vertical leg of the corner key is forced into spacer bar 1 it flexes snugly around small diameter tube 5 and holds that tube firmly against face 2 of the spacer bar. While it is stated in the claims that the small diameter tube passes through the face of the spacer bar, the expression "passing through" is intended to include the arrangement of FIG. 2 in which the small diameter tube moves over the top of the spacer bar but is held in place by the corner key. In practical effect, the result is the same as passing through.

When spacer bars conforming to those described in connection with either FIGS. 1 or 2 are employed, deflection of the panes due to pressure change is prevented since the small diameter tube permits air to enter the space between the panes when the outside pressure is higher due to changing atmospheric pressure or due to the fact that the temperature has dropped and the air occupying the space between the panes has contracted and the pressure has resultingly decreased and air enters the space between the panes. When the pressure in the space between the panes exceeds atmospheric pressure, either as a result of a drop in atmospheric pressure, or as a result of heating of the air in the space between the panes, the higher pressure air in the space between the panes moves through the small diameter tube to the outside atmosphere. The diameter of the small diameter tube is less than 0.07 inches and usually greater than about 0.01 inch. The employment of tubes of such small diameter permit pressure equalization by flow of air through the tube from the point of higher pressure to the point of lower pressure but the diameter is so small that there is no appreciable diffusion of water vapor from the atmosphere to the interior of the space between the panes thru the small diameter tube.

The absorbent which is employed in the spacer bar when it is placed in the window may be any solid adsorbent which has an appreciable capacity for the adsorption of water and which, upon being heated, gives up the adsorbed water. Silica gel, activated alumina and molecular sieve zeolites are all useful adsorbents. The preferred adsorbent, however, is Type 3A molecular sieve zeolite which has excellent capacity for adsorption of water vapor but which does not adsorb nitrogen or oxygen and therefore does not contribute to causing pressure changes in the space between the panes when exterior temperature varies.

When at least one of the vertical spacer bars of a double glazed window conforms to the described spacer bar, deflection of the panes is eliminated and the activity of the adsorbent is maintained as a result of the desorption of water vapor from the adsorbent when air flow is from the space between the panes to the outside atmosphere.

What is claimed is:

1. In a double glazed window comprising two panes of glass in congruent relationship and vertical and horizontal spacer bars lying between the panes along their peripheries to enclose an air space between the panes, at least one of the spacer bars being filled with particulate solid adsorbent accessible to the air enclosed in the space between the panes thru small openings in the inner face of the spacer bar, the improvement which comprises employing as at least one of the vertical spacer bars, as permanently installed in said window, a spacer bar having:

(a) at least a segment of its length filled with a particulate solid adsorbent, (b) at least one small opening in the surface of the spacer bar facing the space between the panes, and (c) a small diameter breather tube passing through the surface of the spacer bar facing the atmosphere and extending downwardly in the adsorbent mass a distance of at least 5 inches, one end of the tube being open to the atmosphere and the other end being open to the interior of the bar and being at a point at least 5 inches from said at least one small opening.

2. A double glazed window as defined in claim 1 wherein the spacer bar has additional small openings in its surface facing the space between the panes, at least one pair of adjacent openings in the adsorbent filled segment of the bar being spaced at least 10 inches apart from each other, the interior end of the breather tube being so positioned that at least 5 inch segments of adsorbent filled spacer bar be between it and each of said pair of adjacent small openings in the surface facing the space between the panes.

3. The double glazed window defined in claim 1 or claim 2 wherein the particulate solid adsorbent is selected from the group consisting of silica gel, activated alumina and molecular sieve zeolite.

4. The double glazed window defined in claim 1 or claim 2 wherein the particulate solid adsorbent is 3A molecular sieve zeolite.

5. The double glazed window defined in claim 1 or claim 2 wherein the exterior portion of the breather tube passing through the surface of the spacer bar facing the atmosphere is bent downwardly to lie close to said surface.

6. A spacer bar for use in double glazed windows comprising (a) an elongated conduit having a generally rectangular cross section, (b) a plurality of small openings in one of two opposite parallel faces of the conduit, said openings being so spaced from each other along the length of the conduit that each opening is at least 10 inches from each adjacent opening, (c) a small diameter tube passing through the other of the two parallel faces of the conduit, (d) the portion of the small diameter tube lying inside the conduit extending downwardly in the conduit to a point between an adjacent pair of small openings such that the end of the small diameter tube is at least 5 inches from each of the adjacent pair of small openings.

7. The spacer bar defined in claim 6 wherein, the portion of the small diameter tube outside the conduit extends downwardly along and generally parallel to the other parallel face of the conduit.

* * * * *